US006282811B1

(12) United States Patent
Voth

(10) Patent No.: US 6,282,811 B1
(45) Date of Patent: Sep. 4, 2001

(54) METHOD OF AND DEVICE FOR THERMAL TREATMENT OF A CONTINUOUS PRODUCT WEB BY BLOWING OF STEAM

(75) Inventor: Marc-Aurel Voth, Hamburg (DE)

(73) Assignee: Babcock Textilmaschinen GmbH, Seevetal (DE)

( * ) Notice: Subject to any disclaimer, the term of this patent is extended or adjusted under 35 U.S.C. 154(b) by 0 days.

(21) Appl. No.: 09/460,695

(22) Filed: Dec. 14, 1999

(30) Foreign Application Priority Data

Dec. 19, 1998 (DE) ..... 198 58 839

(51) Int. Cl.[7] ..... F26B 5/04

(52) U.S. Cl. ..... 34/417; 34/446; 34/633; 34/634; 432/59

(58) Field of Search ..... 34/417, 446, 454, 34/459, 461, 541, 611, 614, 629, 633, 634, 242; 432/8, 59

(56) References Cited

U.S. PATENT DOCUMENTS 4,551,928 * 11/1985 Gottschalk ..... 34/82
5,105,558 * 4/1992 Curry ..... 34/219 X
5,429,303 * 7/1995 Winheim ..... 239/110
5,855,476 * 1/1999 Gottschalk ..... 432/59
5,946,819 * 9/1999 Reimer et al. ..... 34/633 X

FOREIGN PATENT DOCUMENTS 1 460 574 9/1969 (DE) .
27 27 971 1/1979 (DE) .
29 51 299 A1 7/1981 (DE) .
23 10 195 C2 1/1983 (DE) .
42 26 107 A1 2/1994 (DE) .
195 46 344 A1 6/1997 (DE) .

OTHER PUBLICATIONS

K. Kroell: "Trockner Und Tracknungsverfahren", Trocknungstechnik, Von O. Krishcher Und K. Kroell, Springer–Verlag, 1959.

* cited by examiner

*Primary Examiner*—Stephen Gravini
(74) *Attorney, Agent, or Firm*—Michael J. Striker

(57) ABSTRACT

In a method and a device for thermal treatment of a continuous product web by blowing of steam, a product web is transported through an inlet slot, an interior of the housing and an outlet slot and steam is blown onto the product web through nozzle openings of nozzle boxes, steam is blown onto the product web before the inlet slot of the housing in a sluice.

16 Claims, 3 Drawing Sheets

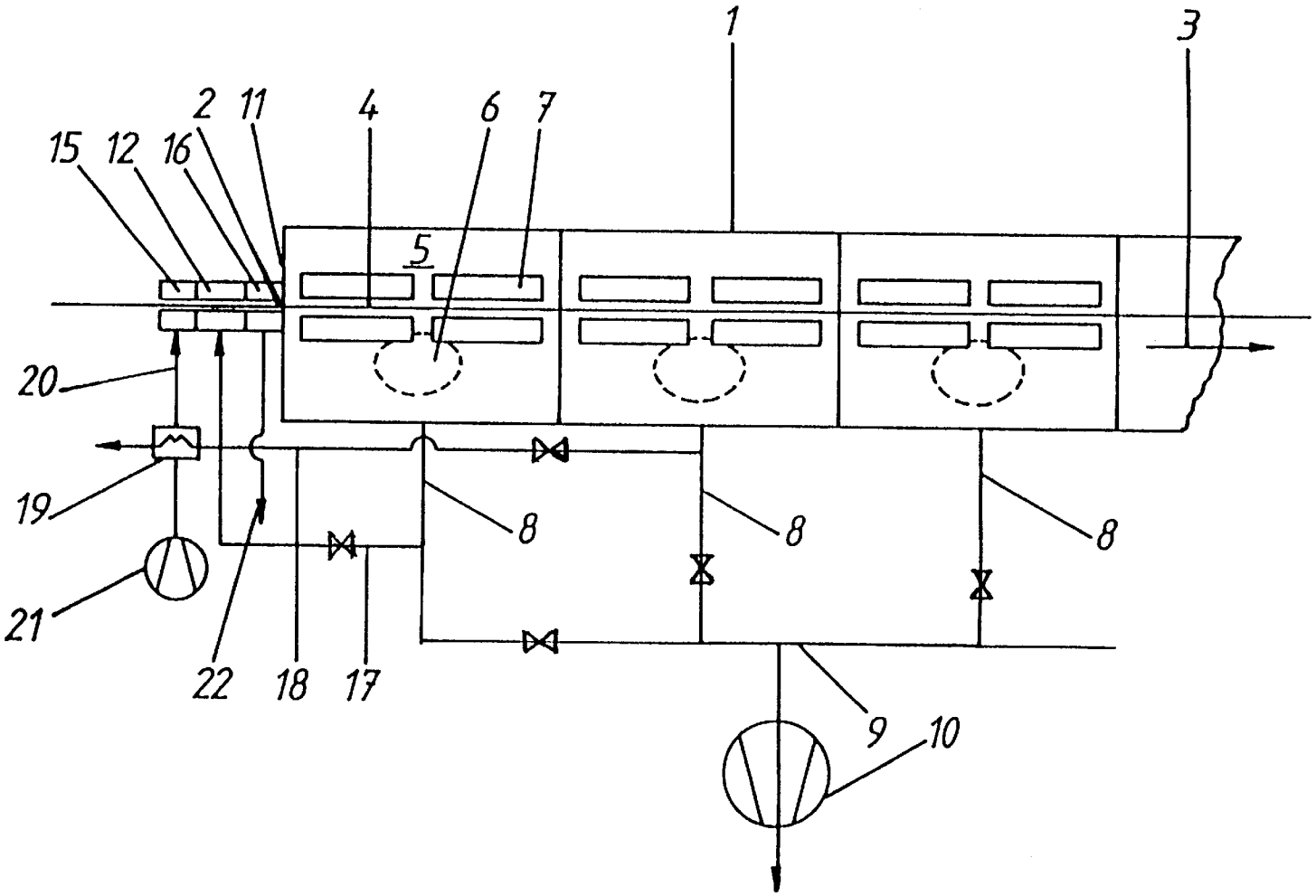
Figur 1

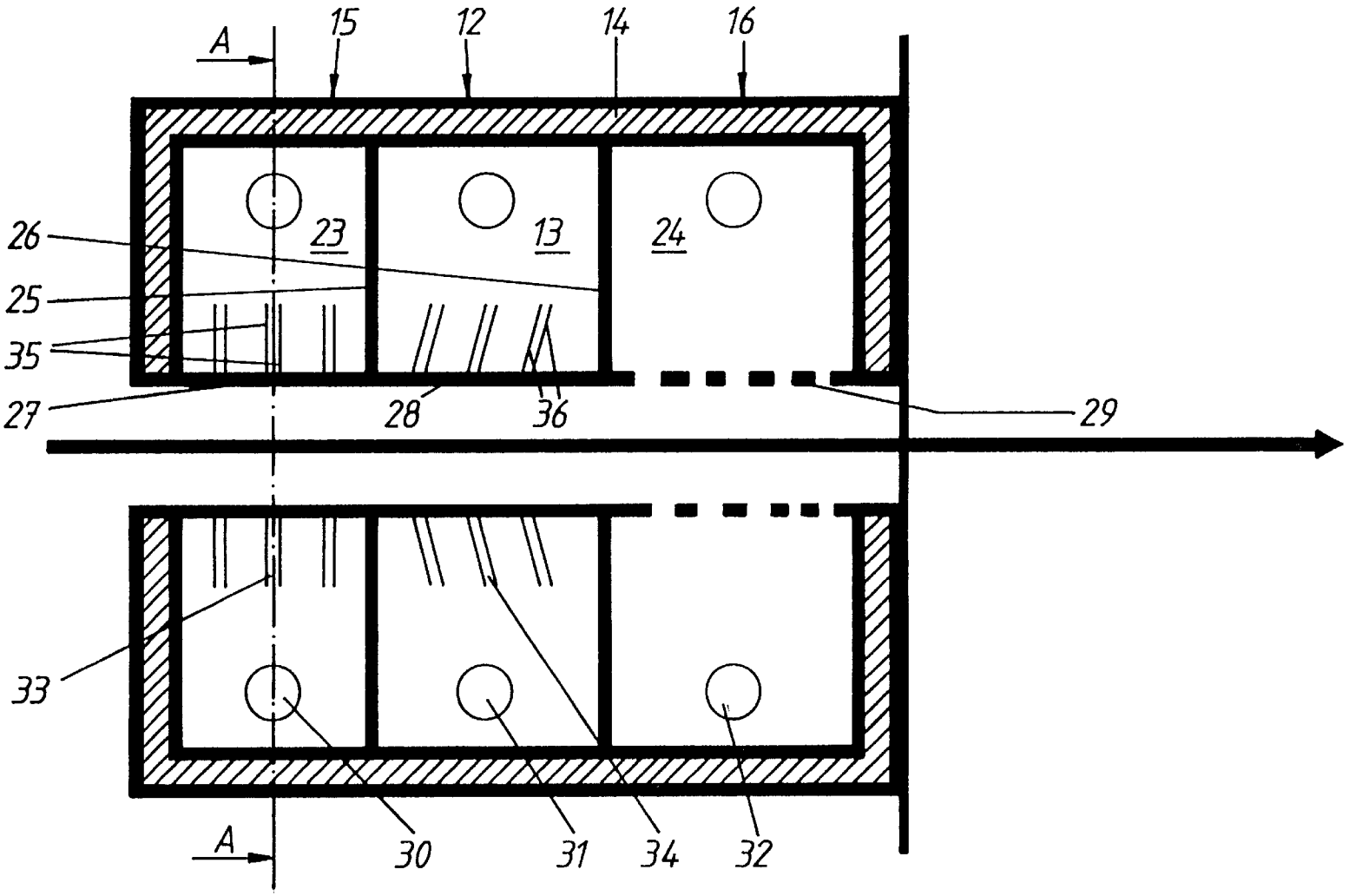
Figur 2

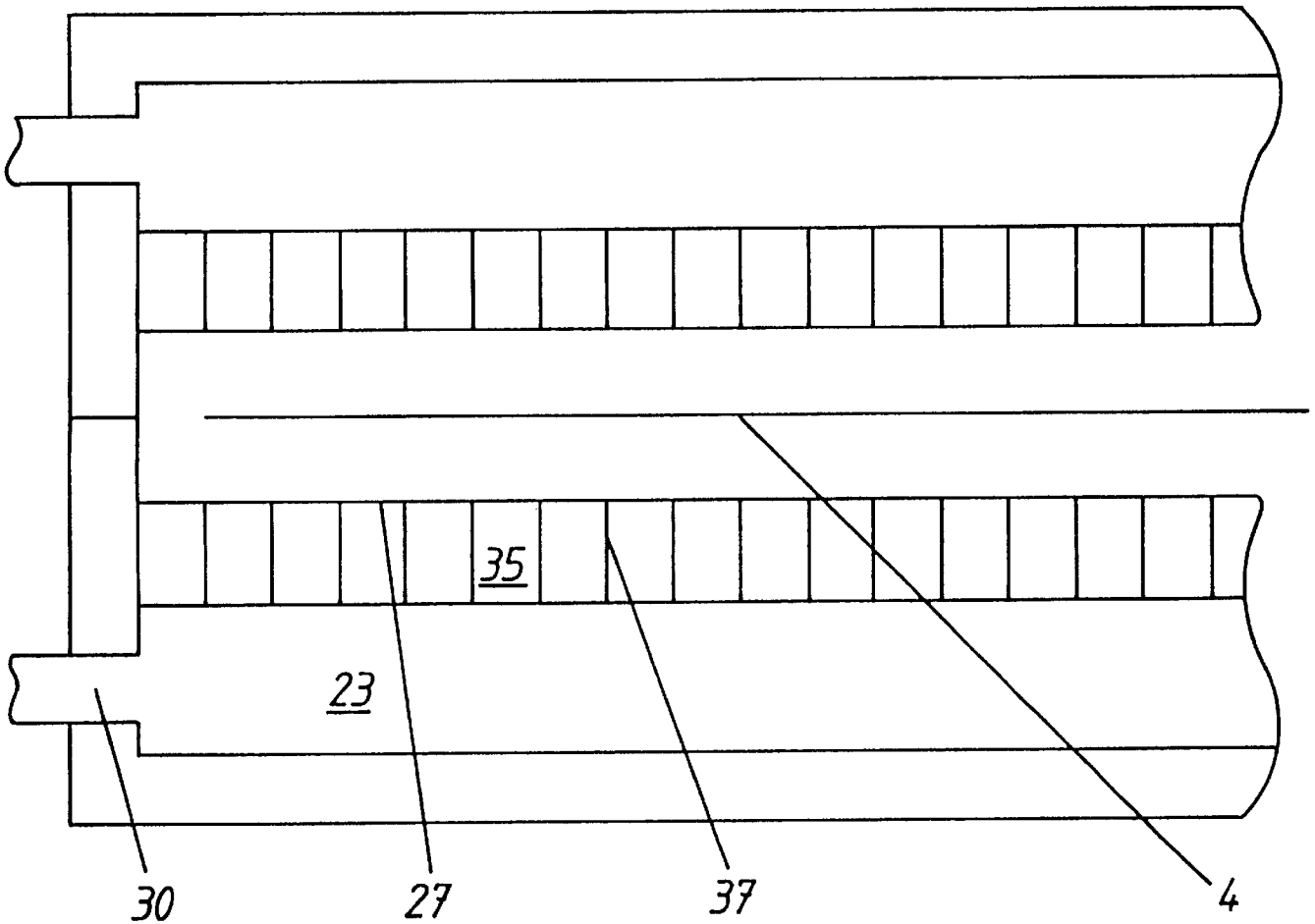
Figur3

METHOD OF AND DEVICE FOR THERMAL TREATMENT OF A CONTINUOUS PRODUCT WEB BY BLOWING OF STEAM

BACKGROUND OF THE INVENTION

The present invention relates to a method of thermal treatment of a product web by blowing of steam, as well as to a corresponding device for thermal treatment.

During a process of thermal treatment of a continuous product web the steam is blown in a recirculating air process through nozzle boxes onto the product web and after heating is supplied again. A device for performing this process which is identified herein below as a steam dryer, has a steam-tight housing with an inlet and an outlet slot and a transporting device for the product web. Frequently several treatment fields are arranged one behind the other, and each field is provided with a device for supplying of steam in the recirculating air process.

The thermal treatment can include a drying, a drying with a fixing, or a pure fixing. All fields of the steam dryer or only some of the fields can be operated with steam. The continuous product webs to be treated are preferably textile webs. Also they can be represented by paper webs or foil webs or the like. The product webs are transported by a transporting device, for example with tension chains, with a roll table or with a sieve band through the steam dryer. The transporting device can also have a nozzle box provided with air nozzles for free-floating guidance of the product web.

The advantages of a thermal treatment, in particular a treatment with pure hot steam, which provides especially high efficiency or quality improvement are described already in the book "Dryers and Drying Processes" of K. Kroll, Springerverlag 1959. In order to use these advantages in practice, there are some difficulties to build the hot steam dryer so tight that no air can penetrate into it. Critical places at which leak stream can occur are the inlet and outlet slots as well as all other openings, for example for conductors, shafts or doors.

In a method and device disclosed in the German patent document DE 195 46 344 the penetration of air is substantially suppressed by providing all critical places in the bottom of the housing and arranging suction boxes which extend in the housing at both sides of the inlet slot and the outlet slot. The steam produces in the whole inner space of the housing an overpressure which is especially high in the vicinity of the bottom. Also, in the regions which are in communication at the suction side with the blowers a small overpressure of the atmosphere is produced. Excessive steam escapes through the inlet slot and the outlet slot and is aspirated by the suction boxes.

The problem is however that the product webs transported through the inlet slot is substantially colder than the steam in the inner space of the housing. Thereby this can lead to an undesired condensation of the steam in the inlet region.

The German document DE 27 27 971 discloses a device for thermal treatment of a continuously moving product web, in which for reducing the entry of space air in a treatment chamber at the outer side a nozzle system is provided as a sealing in the product web inlet and outlet openings provided in a wall of the treatment chamber. A nozzle system contains a first nozzle pair which adjoins the chamber opening and is connected with a point of the treatment chamber located at a negative pressure, as well as a following second nozzle pair which is connected with the pressure side of a fan communicating at a suction side with the atmosphere.

The arrangement of the nozzle system which is known from German document DE 27 27 971 in a steam dryer is however not possible since steam dryers operate with overpressure. In particular, in the places in the interior of a steam dryer with under pressure, the danger of leakage streams is increased. By the connection of a first nozzle pair with a place located at a negative pressure in the steam dryer, the air which is aspirated by the fan from the atmosphere and supplied to the second nozzle pair will go into the steam dryer. A penetration of space air can therefore not be prevented reliably. Also it is disadvantageous that the cold web which is transported through the product web inlet opening can cause in many instances an undesired condensation of the steam.

A further drying device, in particular for paper webs is disclosed in German document DE-A 42 26 107. This drying device has a dryer with additional nozzle boxes at both sides of the inlet and outlet slot. Conduits for pre-heated treatment air lead to the nozzle boxes. The nozzle boxes are provided with nozzle openings whose blowing direction is oriented at an acute angle to the web guiding plane on the inlet slot. For this purpose the nozzle boxes in section are profiled in a saw-toothed manner. The penetration of cold surrounding air through the inlet slot must be suppressed by a passing adjustment between the outlet speed of the blowing jets and the negative pressure produced in the interior of the dryer. The negative pressure prevents escape of solvents which become volatile during drying. Contrary to this, a steam dryer must be operated in the over pressure. Therefore the method disclosed in the German document DE-A 42 26 107, which makes possible a pre-heating of the product web and a suppression of the penetration of cold surrounding air can be used in the steam dryer. Disadvantage is in particular the fact that in each case the pre warmed treatment air penetrates into the dryer. In a steam dryer no air must however penetrate into it.

A thermal treatment device which is different from the devices for thermal treatment of continuous webs, namely a suspension loop steamer in which the product web is guided through the treatment on supporting bars of the rotating chain in a freely suspending loop is disclosed in the German document DE 29 51 299. This suspension loop steamer is provided with an air or steam sluice on an inlet slot located in the bottom. It does not disclose any information on the construction and operation of the sluice. In contrast to a steam dryer, in which steam is blown on a continuously moving product web and is continuously circulated, the steam flow and the product web speed in a suspension loop steamer is substantially smaller, or in other words the requirements to a sluice are lower.

SUMMARY OF THE INVENTION

Accordingly, it is an object of present invention to provide a method of thermal treatment of a continuous product web by blowing of vapor, as well as to a device for thermal treatment of a continuous product web which avoids the disadvantages of the prior art.

More particularly, it is an object of present invention to provide a method of and a device for thermal treatment of a continuous product web in which practically no air, neither air of surrounding temperature nor heated air, can penetrate into the interior of the device, and a condensation of the steam in the input region on the product web is avoided.

In accordance with present invention, steam is blown additionally into a sluice before the inlet slot of the housing onto the product web. The air which surrounds the product web is displaced by the steam, whereby a penetration of air into the interior of the housing is prevented. Moreover, the product web is warmed up by the blowing steam because of the high thermal capacity of the steam with high efficiency. This reduces the danger of a condensate formation in the inlet region in the interior of the housing.

A steam speed can be 20–40 m/s. This guarantees that the steam impinging on the product web displaces the air border layer and avoids the entry of the air into the housing.

In contrast to the method disclosed in German document DE 195 46 344, in which the product web is guided through the bottom into the housing and from the housing, the inventive blowing of steam in the sluice makes possible a horizontal guidance of the product web. The product web is transported in a substantially horizontal plane through the inlet slot, the housing, and the outlet slot. The horizontal product web guidance simplifies the transporting device and improves the accessibility of the product web and the inlet into the housing and at the outlet. Eventual non-uniformities of the product web, which can be produced during its deviation in the inlet and outlet slot through the bottom, are avoided.

In accordance with a further feature of the present invention a part of the spent steam is supplied into the sluice. This makes an additional steam source unnecessary. In accordance with a further feature of the present invention the spent steam which is taken from the front region of the device is not contaminated or is contaminated substantially less with oils of the preparation agents from the rear region of the device.

In accordance with still a further feature of the present invention, before blowing of steam into the sluice, heated air is blown onto the product web. This leads to a pre-warming of the product web and prevents the contact of steam exiting the sluice with cold surrounding air, which can lead to a condensation of the steam.

In accordance with another feature of the present invention, before blowing of steam or after blowing of heated air and/or behind the blowing of steam into the sluice, gas is aspirated. Aspiration of gas, for example in some cases heated air or steam increases the reliability that no air can penetrate into the interior of the steam dryer. An aspiration of the steam behind the steam supply makes possible a blowing of steam with a higher pressure.

In accordance with a further feature of present invention, first heated air is blown into the sluice, then steam is blown, and then the steam is aspirated. Therefore the steam supplied into the sluice can be supplied with a pressure which corresponds to the pressure in the interior of the steam dryer.

A device in accordance with the present invention is provided with a sluice located before the inlet slot and having at least one steam chamber with nozzle boxes, to which a steam supply is connected. In accordance with another feature of present invention the nozzle box has slot nozzles for one or several chambers of the sluice. This makes possible an especially intensive contact of the steam or the heated air with the product web and a good heat transfer.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a schematic side view of one of three fields of a steam dryer in accordance with the present invention, with a sluice and conduits connected to the sluice;

FIG. 2 is a view showing a longitudinal section of the same on an enlarged scale; and FIG. 3 is a view showing a section taken along the line A—A of FIG. 2.

DESCRIPTION OF PREFERRED EMBODIMENTS

A device for thermal treatment of a continuous product web in accordance with the present invention which is formed as a steam dryer has a steam-tight heat-insulated housing 1 provided with an inlet slot 2, an outlet slot which is not shown in FIG. 1 and a transporting device which is also not shown in FIG. 1. The transporting device transports a product web 4 through the steam dryer in a transporting direction 3. Several fields, for example 6 fields are arranged one after the other. Only three fields are shown in FIG. 1. At least one field is a steam field 5. It is provided with a device for guiding steam in a recirculating air process with a recirculating fan 8 shown in a broken line and a not shown heating device, and with nozzle boxes 7 which are provided with nozzle openings directed toward the product web 4.

One or several remaining fields can be air fields. They can be provided with a device for guiding of first heated air in a recirculating air process with a recirculating fan and with nozzle boxes having nozzle openings which are directed toward the product web.

In this example all six fields are steam field 5. Each fields has several nozzle boxes 7, for example two nozzle boxes arranged above and two nozzle boxes arranged below the product web 4 and extending transversely over the product web 4. A steam withdrawal conduit 8 extends through each steam field 5. The steam withdrawal conduits 8 of the rear fields open into a collecting conduit 9. The collecting conduit 9 leads to the suction fan 10. The inlet slot 2 is provided on a front wall 11 of the housing 1, and the outlet slot is provided on the rear wall of the housing 1. The transporting device forms a horizontal transporting plane in the interior of the housing 1 for the product web 4. The inlet slot 2 and the outlet slot are arranged on the horizontal transporting plane. In other words, they are formed so that the product web 4 is guided through the inlet slot 2, through the housing 1 and through the outlet slot on a horizontal transporting plane. For example, a transporting device provided with the tension chain and extending through the inlet slot through the housing and through the outlet slot, runs on a horizontal plane. The transporting device can be also formed as a roll table or a sieve band. It can be also provided with means for free floating of the product web, such as nozzle boxes with air cushion nozzles.

A sluice with at least one steam chamber 12 with nozzle boxes 13 is arranged before the inlet slot 1. In this example, the sluice has a steam-tight, heat-insulated housing 14 which is subdivided into three chambers located one after the other in the transporting direction 3. The chambers include an air chamber 15, a steam chamber 12 and a suction chamber 16.

A steam supply conduit 17 which is connected with a steam withdrawal conduit 18 of a front steam field 5, here the first field, is connected to the steam chamber 12.

A steam supply conduit 18 which is connected with a steam withdrawal conduit 8 of another steam field 5, here the second field, leads through a heat exchanger 19, through which also an air conduit leads. It extends on the one hand with a suction side of a fan 21 which is open to atmosphere outside of the steam dryer, and is connected behind the heat exchanger 19 with the air chamber 15 of the sluice.

A suction conduit 22 which leads to a not shown fan, is connected to the suction chamber 16. The chamber 15, 12, and 16 of the sluice has nozzle boxes. In this example each chamber is provided with nozzle boxes 23, 13, 24 which extend through the whole product web width and are arranged above and below the guiding plane of the product web 4 in a mirror-symmetrical arrangement. The nozzle boxes 23, 13, 14 are formed by the housing 14 of the sluice, each having two intermediate holes 25, 26 and their bottom plates 27, 28, 29. Openings 30, 31, 32 are provided in their side walls. The openings 30, 31, 32 of both opposite nozzle boxes 23, 13, 24 of chambers 15, 12, 16 are correspondingly connected with one another, by a not shown conduit. Conduits connected to the chambers 15, 12, 16 namely the air conduit 21, can open in the corresponding conduits into the steam supply conduit 17 and withdrawal conduit 22.

The nozzle boxes 23 and 13 of the air chamber 15 and the steam chamber 12 have slot nozzles 32, 34 which are mounted on the bottom plates 27, 28. The slot nozzles 24 of the nozzle boxes 13 of the steam chamber 12 are oriented inclinedly, opposite to the transporting direction 3 of the product web 4. The bottom plate 28 of the aspiration chamber 16 has suction openings 35, for example round openings. The bottom plate 39 can be perforated.

The slot nozzles 33, 34 have each two side plates 35, 36 and a guiding plate 37 which subdivides their slots. The side plates 35, 36 extend over a width which at least corresponds to the maximum width of the product web 4. In other words, conventionally they extend over the whole length of the nozzle boxes 23 and 13. The guiding plates 37 are arranged parallel to the transporting direction 3 and subdivide the slots in the identically big flow openings. They serve for the distribution of the flow of the air and steam over the product web 4.

The sluice with the three chambers 15, 12 and 16 extends over the total product web width. Its length corresponds substantially to 1 m and its total height corresponds substantially to 0.8 m.

In accordance with the inventive method of drying, the steam is supplied in the steam fields 5 in a recirculating process. Steam is blown onto the throughgoing product web 4 through nozzle openings of the nozzle boxes 7 oriented toward the product web 4. The steam after the contact with the product web 4 is withdrawn as spent steam by means of the recirculating air fan, is again heated by the heating device to the desired temperature, and again supplied back. The steam after a starting phase, in which the hot steam is supplied from outside, is produced permanently by drying of the product web 4. Thereby an overpressure is maintained in the inner space of the housing 1 before the inlet slot 2 and before the outlet slot.

A part of the steam is withdrawn after contact with the product web 4 as spent steam through the steam withdrawal conduits 8. By controlling the quantity of the withdrawn spent steam, the steam quantity exiting the inlet slot and the outlet slot can be maintained at a predetermined value.

Steam is blown onto the product bath 3 in the sluice before the inlet slot 2 into the steam chamber 12 uniformly through the slot nozzles 34. This steam is a partial stream of the spent steam which is withdrawn from the steam fields 5 after the conduct with the product path 4 as spent steam, and a partial stream of the spent steam which is withdrawn from the first steam field 5 and supplied through the steam supply conduit 17.

Heated air is blown in the sluice before the supply of steam in the preceding air chamber 15 onto the product web 4 and uniformly through the slot nozzles 33. The heated air is produced by heating of fresh air in the heat exchanger 19 which is supplied with spent steam of the second steam field 5.

Subsequently to the supply of the heated air and the supply of steam, in the suction chamber 16 of the sluice before the inlet slot 2 steam is aspirated form the steam chamber 12 and steam is aspirated from the interior of the housing 1 into the suction chamber 16.

Steam can be blown into the steam chamber with a pressure of approximately of 0.2 bar for example 0.5 bar, above the pressure in the device.

It will be understood that each of the elements described above, or two or more together, may also find a useful application in other types of methods and constructions differing from the types described above.

While the invention has been illustrated and described as embodied in method of and device for thermal treatment of a continuous product web by blowing of steam, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method of thermal treatment of a continuous web, comprising the steps of blowing steam onto the product web in a device with a steam-tight housing; transporting the product web through an inlet slot in the housing, then through the housing, and through an outlet slot of the housing; guiding the stream in at least one steam field in a recirculating air process; blowing the steam through nozzle openings of nozzle boxes; maintaining an over pressure in the housing; blowing steam onto the product web in a sluice before the inlet slot of the housing; and aspirating gas in the sluice before the inlet slot of the housing in a step selected from the group consisting of prior to blowing of steam and after blowing of steam.

2. A method as defined in claim 1; and further comprising the step of blowing the steam in the sluice with a steam speed of 20–40 m/s onto the product web.

3. A method as defined in claim 1, wherein said transporting includes transporting the product web through the inlet slot, the housing and the outlet slot in a substantially horizontal plane.

4. A method as defined in claim 1; and further comprising the steps of withdrawing a part of the steam after contact with the product web as a spent steam; and supplying the steam into a sluice as a partial flow of the spent steam.

5. A method as defined in claim 1; and further comprising the step of withdrawing the spent steam supplied into the sluice from the front region of the device.

6. A method as defined in claim 1; and further comprising blowing heated air onto the product web in the sluice before the inlet slot of the housing prior to the blowing of steam.

7. A method as defined in claim 1; and further comprising the steps of supplying in the sluice first heated air, then supplying steam, and finally aspirating the steam.

8. A method as defined in claim 1; and further comprising the steps of supplying in the sluice first heated air, then aspirating the heated air, and finally supplying steam.

9. A device for thermal treatment of a continuous product web by blowing of steam, comprising a steam-tight housing with an inlet slot and an outlet slot; transporting means for transporting the product web through said inlet slot, an interior of said housing, and said outlet slot; at least one steam field; means for guiding steam in recirculating process; nozzle boxes with nozzle openings oriented toward a product path; and a sluice located before said inlet slot and having at least one steam chamber with nozzle boxes, to which a steam supply conduit is connected, said sluice having at least one suction chamber arranged at a location selected from the group consisting of after said steam chamber and before said steam chamber.

10. A device as defined in claim 9, wherein said transporting means is formed so that in the interior of said housing in the region of said inlet slot and in the region of said outlet slot they form a substantially horizontal transporting plane for the product path.

11. A device as defined in claim 9; and further comprising a plurality of steam fields with steam withdrawing conduits, said steam supply conduit to said sluice being connected with one of said steam withdrawing conduits.

12. A device as defined in claim 11, wherein said steam supply conduit for said sluice is connected with a steam withdrawing conduit which is connected with a front region of the device.

13. A device as defined in claim 9, wherein said sluice has an air chamber located before said suction chamber and provided with nozzle boxes which an air supply conduit is connected.

14. A device as defined in claim 1, wherein said sluice has an air chamber, a steam chamber and a suction chamber located one after the other in a transporting direction.

15. A device as defined in claim 9, wherein said nozzle boxes of at least one chamber of said sluice have slot nozzles.

16. A device as defined in claim 9, wherein said nozzle boxes of several chambers of said sluice have slot nozzles.

* * * * *